US005674098A

United States Patent [19]

Inaba et al.

[11] Patent Number: 5,674,098

[45] Date of Patent: Oct. 7, 1997

[54] CONNECTOR APPARATUS

[75] Inventors: Shigemitsu Inaba; Hisaharu Katoh, both of Shizuoka, Japan

[73] Assignee: Yazaki Corporation, Tokyo, Japan

[21] Appl. No.: 385,426

[22] Filed: Feb. 8, 1995

[30] Foreign Application Priority Data

Feb. 8, 1994 [JP] Japan ..... 6-034224

[51] Int. Cl.[6] ..... H01R 11/11

[52] U.S. Cl. ..... 439/883; 439/205; 439/709

[58] Field of Search ..... 439/709, 205, 439/206, 752, 825, 860, 883

[56] References Cited

U.S. PATENT DOCUMENTS

| | | | |
|---|---|---|---|
| 412,889 | 10/1889 | McIntire | 439/883 X |
| 2,968,788 | 1/1961 | Neaderland et al. | 439/883 |
| 4,662,706 | 5/1987 | Foley | 439/843 X |
| 4,679,888 | 7/1987 | Williams | 439/883 |

FOREIGN PATENT DOCUMENTS 56-59783 5/1981 Japan .

*Primary Examiner*—Khiem Nguyen

*Attorney, Agent, or Firm*—Sughrue, Mion, Zinn, Macpeak & Seas

[57] ABSTRACT

Terminals for a low-cost connector apparatus, and the connector apparatus using the terminals, are provided. Each of the connection portions of the terminals for connecting wiring materials is formed by cutting an electrically conductive pipe material into a specific length and then crimping flat one end thereof. The uncrimped end retains its cylindrical shape, and is formed into a fit-engagement portion into which another terminal is inserted to make current conduction possible. The connector apparatus comprises a first base member having a main portion and a stepped portion, a side wall of the main portion being substantially perpendicular to a top surface of the stepped portion. A second base member, matable with the said first base member, is also provided. Burial holes are provided in the first base member near the stepped portion, and the inventive terminals are disposed therein. Opening portions are disposed in the side wall of the main portion near the burial holes, to allow the terminals to be inserted. Slits are disposed adjacent the burial holes between the burial holes and the opening portions. Stoppers are insertable into the slits. When inserted, the stoppers fix the terminals in the burial holes and close the opening portions.

13 Claims, 8 Drawing Sheets

CONNECTOR APPARATUS

BACKGROUND OF THE INVENTION

1. Field of the Invention

The present invention relates to a connector apparatus and more particularly relates to a connector apparatus for a distribution panel, or the like, in which a base member having male connectors fixed thereto is insertable into another base member having female connectors fixed thereto, so that current conduction in high-voltage circuits is cut off when the male connectors are disconnected from the female connectors to thereby improve safety.

2. Related Art

In a conventional distribution panel for high-voltage circuits, when the cover of the distribution panel is opened, male connectors fixed to the cover are disconnected from female connectors fixed to a body of the distribution panel. This construction cuts off current conduction in the high-voltage circuits to prevent a human operator from receiving an electric shock because of his touching of the electrodes by mistake. In an electric car (on which attention has been focused as a pollution-free vehicle free from exhaust gas), it is necessary to insure that a human operator is prevented from receiving an electric shock when the electric car is subjected to maintenance, because a high-voltage portion for driving a motor is provided in the electric car.

In a conventional electric car, therefore, a switch for cutting off current conduction in the high-voltage circuit is provided so that the switch is operated before the maintenance work is performed. There is however a risk of electric shock accidents caused by an operator's forgetting to operate the switch, because it is necessary that not only maintenance experts but also less technically proficient people perform the work of mechanically adjusting the car.

In an electric car, for example, as proposed by the present inventors in Japanese Patent Application No. 114253/1993 (having U.S. Pat. No. 5,476,392 as its counterpart), a connector apparatus serving as a safety plug as shown in FIGS. 12 and 13 is arranged in an electric circuit to thereby prevent the aforementioned electric shock accidents. As shown in FIG. 12, connector apparatus A is constituted by a female connector 2 fixed to a first base member 1, and a male connector 4 mounted to a second base member 3 serving as a cover for the first base member 1 so as to be rotatable around a rotation shaft B provided at an end of the first base member 1. Ends 2*a* and 2*b* of the female connector 2 are partly exposed to the external surface of the first base member 1 so that high-voltage wires 5*a* and 5*b* are connectable to the ends 2*a* and 2*b* from the outside.

As shown in FIG. 13, the male connector 4 includes a guide 7 which is mounted on the second base member 3 by bolts 6, and a connector body 8 which is loosely fitted in the inside of the guide 7 so as to be movable both vertically and horizontally with respect to the axis of the rotation shaft B. The guide 7 is constituted by an oblong substrate 9 which is in close contact with the second base member 3 and which has long sides in parallel with the rotation shaft B, and a rectangular parallelpiped box-like material 10 which is provided integrally with the substrate 9.

The connector body 8 of the male connector 4 is constituted by a rectangular parallelpiped base portion 11 made of an insulating resin material, a guide member 12 provided integrally with the base portion 11 so as to project from the base portion 11, and electrode pins 13 made of copper and provided in the base portion 11 so as to be suspended in parallel with the guide member 12. The electrode pins 13 are provided as a metal fitting that is substantially U-shaped in front view. The base portion of the metal fitting is formed integrally with the base portion 11 by resin molding so as to be farther away from the rotation shaft B than the guide member 12, as shown in FIG. 12.

When the female connector 2 is to be connected, the second base member 3 is rotated in the direction of the arrow C. The guide member 12 is inserted into a guide hole 2*c* of the female connector 2 to position properly the male connector body 8 with respect to the female connector 2. The electrode pins 13 are inserted into a pair of insertion holes 2*d* and 2*e* formed in the female connector 2. As a result, the female connector 2 is connected so that current conduction can be made through the electrode pins 13. If high-voltage wirings 5*a* and 5*b* are connected to the ends 2a and 2*b* of the female connector 2, current conduction is performed between the two connectors 2 and 4.

When current conduction needs to be cut off, the second base member 3 is rotated in a direction reverse to the direction of the arrow C so that the electrode pins 13 are disconnected from the female connector 2.

The internal structure of the female connector 2 of the connector apparatus is generally made such that a terminal 14 is formed by cutting an electrically conductive material into an L shape as shown in FIG. 14. The terminal 14 is then put into a casing made of a synthetic resin. The connection of high-voltage wires 5*a* and 5*b* to the ends 2*a* and 2*b* may be connector-connection as shown in FIG. 12 or may be terminal-connection using a screw 15 as represented by the virtual line in FIG. 14.

Because the terminal 14 is formed by cutting an electrically conductive material into an L shape, much labor is required for its production. Also, it is difficult to insert terminal 14 into the connector apparatus. This makes the terminal and the connector apparatus expensive. Furthermore, the amount of freedom one has in changing the shape of the terminal is small, so various types of terminals need to be prepared in accordance with standards for the connector apparatus A. Not only this is a barrier to reducing the number of parts, but creates materials management problems.

SUMMARY OF THE INVENTION

It is an object of the present invention to provide a terminal which can be produced easily by using an electrically conductive pipe (a standard article), and a connector apparatus for use with this terminal which can be produced at low cost.

To achieve the above and other objects, a terminal according to a first embodiment is provided which comprises: a crimped center portion; a first end, cylindrically shaped, formed into a fit-engagement portion into which a pin-type terminal can be fitted; and a second end, opposite said first end, formed into a connection portion into which an electric wire can be connected.

Another embodiment of the terminal comprises a first end, cylindrically shaped, formed into a fit-engagement portion into which a pin-type terminal can be fitted; and a second end, opposite said first end, crimped flat to form a connection portion into which an electric wire can be connected. A hole is bored through the flat second end perpendicular to the plane of the flat end. An air hole may be bored in a wall of the first end.

Both of the above two terminals are substantially L-shaped.

A connector apparatus utilizing at least the second embodiment comprises: a first base member, having a main portion and a stepped portion, a side wall of said main portion being substantially perpendicular to a top surface of said stepped portion; a second base member, matable with said first base member; and burial holes, provided in said first base member near said stepped portion. The inventive terminals are provided in the burial holes. Pin-type terminals are provided in the second base member in positions corresponding to the inventive terminals so as to mate with the inventive terminals when the second base member is mated with the first base member. The flat second ends of the terminals are disposed over the top surface of the stepped portion. The flat second ends of the terminals are fastened to said top surface via fasteners disposed through the holes in the flat second ends.

The connector apparatus preferably further comprises: opening portions respectively disposed in said side wall of said main portion near said burial holes; slits, respectively disposed adjacent said burial holes between said burial holes and said opening portions; and stoppers, respectively insertable into said slits, which, when inserted, fix said electrically conductive terminals in said burial holes and close said opening portions.

The pin-type terminals each comprises: a rod-shaped main body having a diameter smaller than an inner diameter of said first end of said electrically conductive terminals; a concave lock portion hollowed out of said main body; and convex plate spring pieces disposed in said concave lock portion bowing away from said concave lock portion, said plate spring pieces engaging said electrically conductive terminals when said pin-type terminals and said electrically conductive terminals are mated.

The aforementioned terminal structure of the connector apparatus is produced so that, for example, one end of an electrically conductive pipe material is crimped formed into a connection portion to which a wire can be connected. The other end of the pipe material remains as a pipe-like shape and is formed into a fit-engagement portion into which a pin-type terminal can be inserted. Accordingly, the terminal structure can be produced very easily compared with the conventional structure which requires cutting and other complicated steps.

Further, the production of the connector apparatus using the terminals having the aforementioned structure is simplified so that it can be produced inexpensively.

Further, terminals can be inserted easily by burying the terminals of the aforementioned structure in burial holes formed in a first base member and then blocking opening portions for inserting the terminals into the burial holes by stoppers. Accordingly, the whole process, from the production of terminals to the inserting of the terminals, is simplified greatly.

DETAILED DESCRIPTION OF THE PREFERRED EMBODIMENTS

An embodiment of a connector apparatus according to the present invention will be described below in detail with reference to FIGS. 1 to 10.

First, the structure of a female terminal 21 adapted to the connector apparatus A and the method of producing the female terminal 21 will be described with reference to FIGS. 2 to 6.

Figure 2:
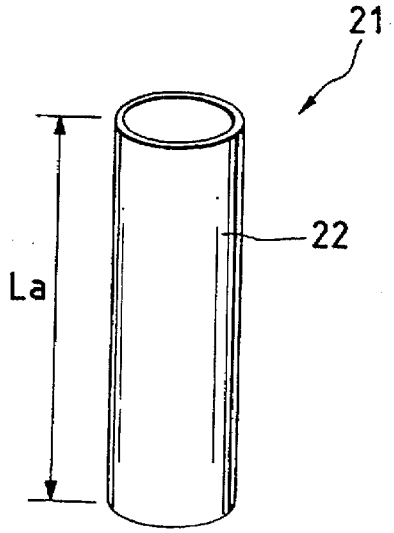
FIG. 2 is a perspective view of a pipe material constituting a female terminal.
Figure 3:
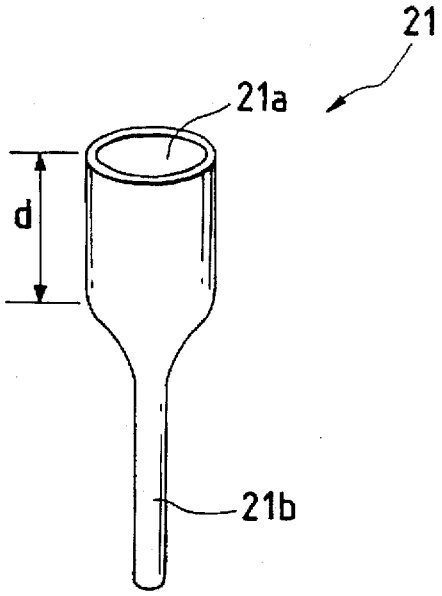
FIG. 3 is a perspective view showing a process of producing a female terminal.

The female terminal 21 is formed in the following manner. An electrically conductive pipe material 22 such as a metal pipe is cut into a specific length La as shown in FIG. 2. An end of the pipe material 22, inclusive of the center portion thereof, is squeezed into the form of a flat plate by pressing or the like as shown in FIG. 3. The pipe material 22 is then bent into an L shape as shown in FIGS. 4 to 6.

Figure 4:
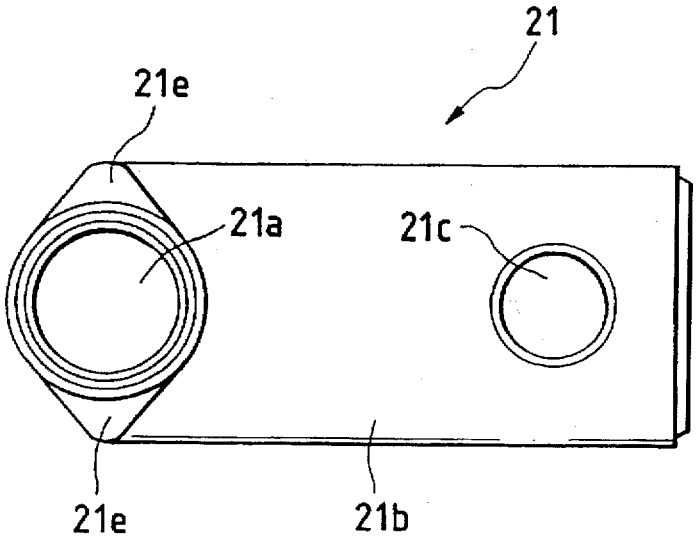
FIG. 4 is a plan view showing the external appearance of the female terminal.
Figure 5:
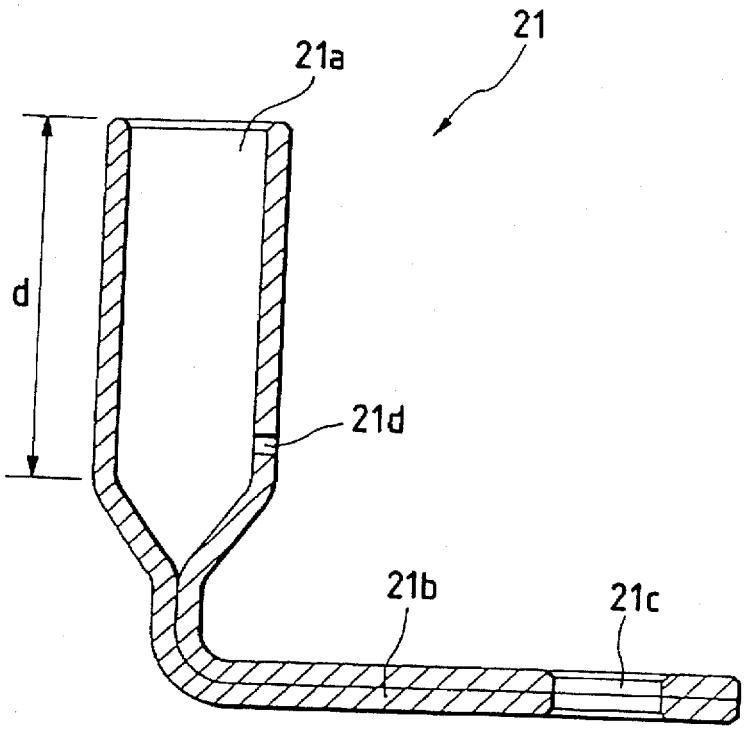
FIG. 5 is a sectional view showing the shape of the female terminal.
Figure 6:
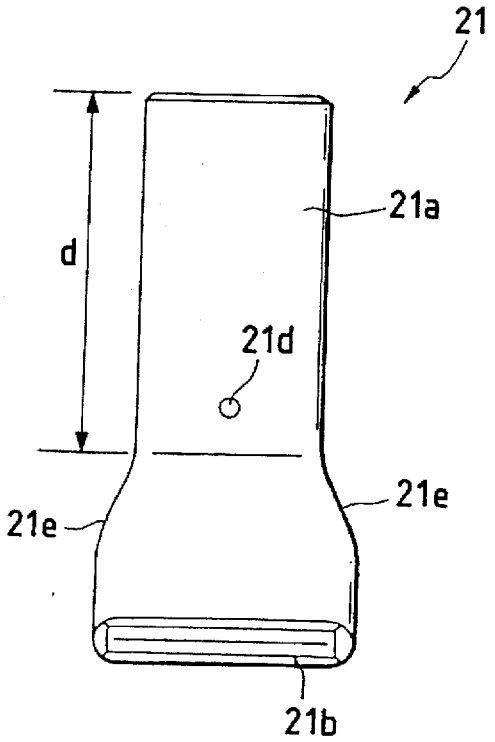
FIG. 6 is a side view showing the external appearance of the female terminal.

As shown in FIGS. 4 and 5, the female terminal 21 thus produced includes a cylindrical fit-engagement portion 21*a*, and a flat connection portion 21*b*. A screwhole 21*c* for connection of a wire which will be described later is formed in the connection portion 21*b*. Further, an air hole 21*d* is formed in a part of the fit-engagement portion 21*a*. The air hole 21*d* is provided to discharge air compressed at the time of insertion of a pin-type male terminal 25 (which will be described later) into the fit-engagement portion 21*a*, to facilitate the insertion of the male terminal 25.

As described above, the female terminal 21 in this embodiment can be produced very easily. As a material for the female terminal 21, an electrically conductive pipe material 22 available as a standard article may be used. Although the preferred material of the pipe is a low resistance material such as copper, a light alloy or the like may be used. Further, rust prevention or plating for improvement of electrical conducting characteristics may be applied onto the surface thereof.

The diameter and depth d of the fit-engagement portion 21*a* and the thickness of the pipe material 22 are selected in accordance with the voltage and quantity of current used and in correspondence to the male terminal 25 which will be described later.

Figure 7:
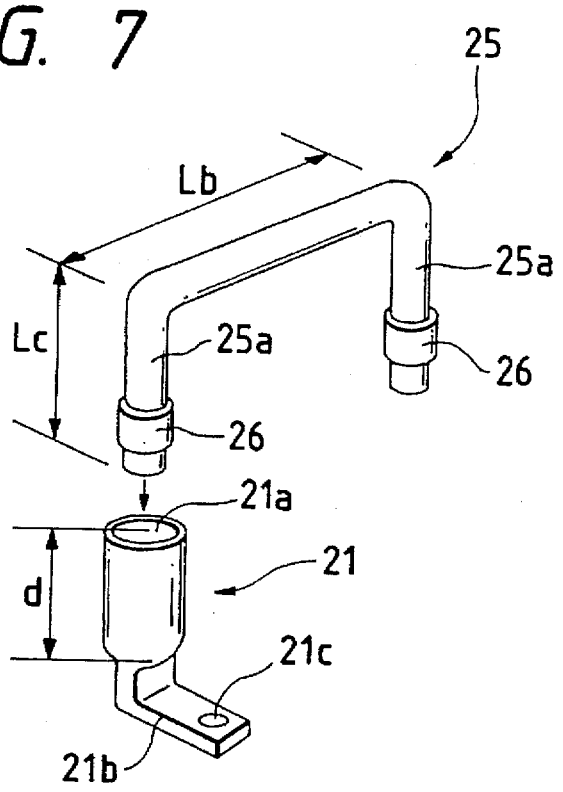
FIG. 7 is a perspective view showing the relation between the female terminal and the male terminal.

Next, the male terminal 25 will be described. As shown in FIG. 7, the male terminal 25 is formed by bending a rod-like electrically conductive material, for example, into a U shape. The diameter of the male terminal 25, the distance Lb between bent portions 25*a* and the length Lc of each of the bent portions 25*a* are selected in accordance with the arrangement of the female terminal 21, the depth d of the fit-engagement portion 21*a*, and so on.

Figure 8:
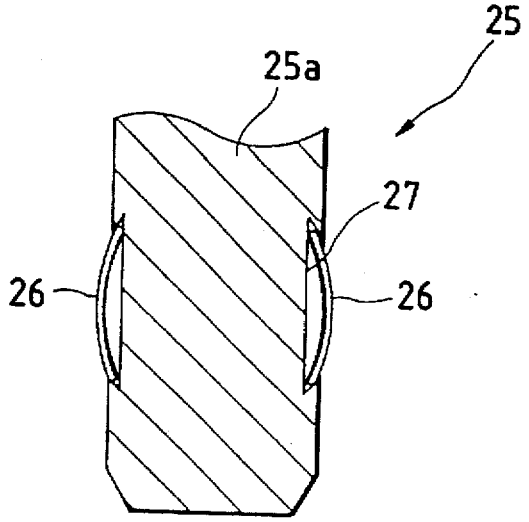
FIG. 8 is a sectional view of the structure of the male terminal.

As shown in FIG. 8, spring pieces 26 are wound on the bent portions 25*a*, respectively, so as be located near respective end portions of the bent portions 25*a*. Each of the spring pieces 26 is provided to make good contact between the male terminal 25 and the female terminal 21 when a bent portion 25*a* is inserted into the corresponding fit-engagement portion 21*a*. Each of the spring pieces 26 is a plate spring having a vertical slit. The plate spring is curved circularly and fitted into a shallow concave lock portion 27 formed at an end portion of the bent portion 25*a* so as not to slip out. When the bent portion 25*a* is inserted into the fit-engagement portion 21*a*, the spring piece 26 is rubbed against the inner wall surface of the fit-engagement hole 21*a* so as to be contracted elastically. When the bent portion 25*a* is disconnected from the fit-engagement hole 21*a*, the spring piece 26 is restored to its original state as shown in the drawing.

Although the connector apparatus A using the male terminal 21 and the female terminal 25 can be used for various purposes, an example in which the structure is applied to a distribution panel for performing current conduction and breaking of a high-voltage circuit by attaching/detaching operations will be described below with reference to FIGS. 9 and 10.

In the connector apparatus A, for example, four female terminals 21 are buried in a first base member 31 at intervals of a predetermined distance. Connection portions 21*b* are exposed respectively on step portions 32 formed in opposite sides of the base member 31. High-voltage wires 5*a*, 5*b*, 5*c*, and 5*d* are connected to the female terminals 21 through the connection portions 21*b*, respectively, by screws or the like.

The two female terminals 21 to which the high-voltage wires 5*a* and 5*b* are connected and the two female terminals 21 to which the high-voltage wires 5*c* and 5*d* are connected are provided in pairs. The pairs of female terminals are arranged in two groups of electric source circuits different in voltage value from each other so that current conduction and cutting-off of the respective electric source circuits can be made.

The connector apparatus A further comprises a second cover-like base member 41 which is engageable with the step portions 32 of the first base member 31 to cover the base member 31. The second base member 41 has male terminals 25 which are fixed to correspond to the female terminals when the second base member 41 is moved down in the direction of the arrow E to be put over the first base member 31.

Figure 9:
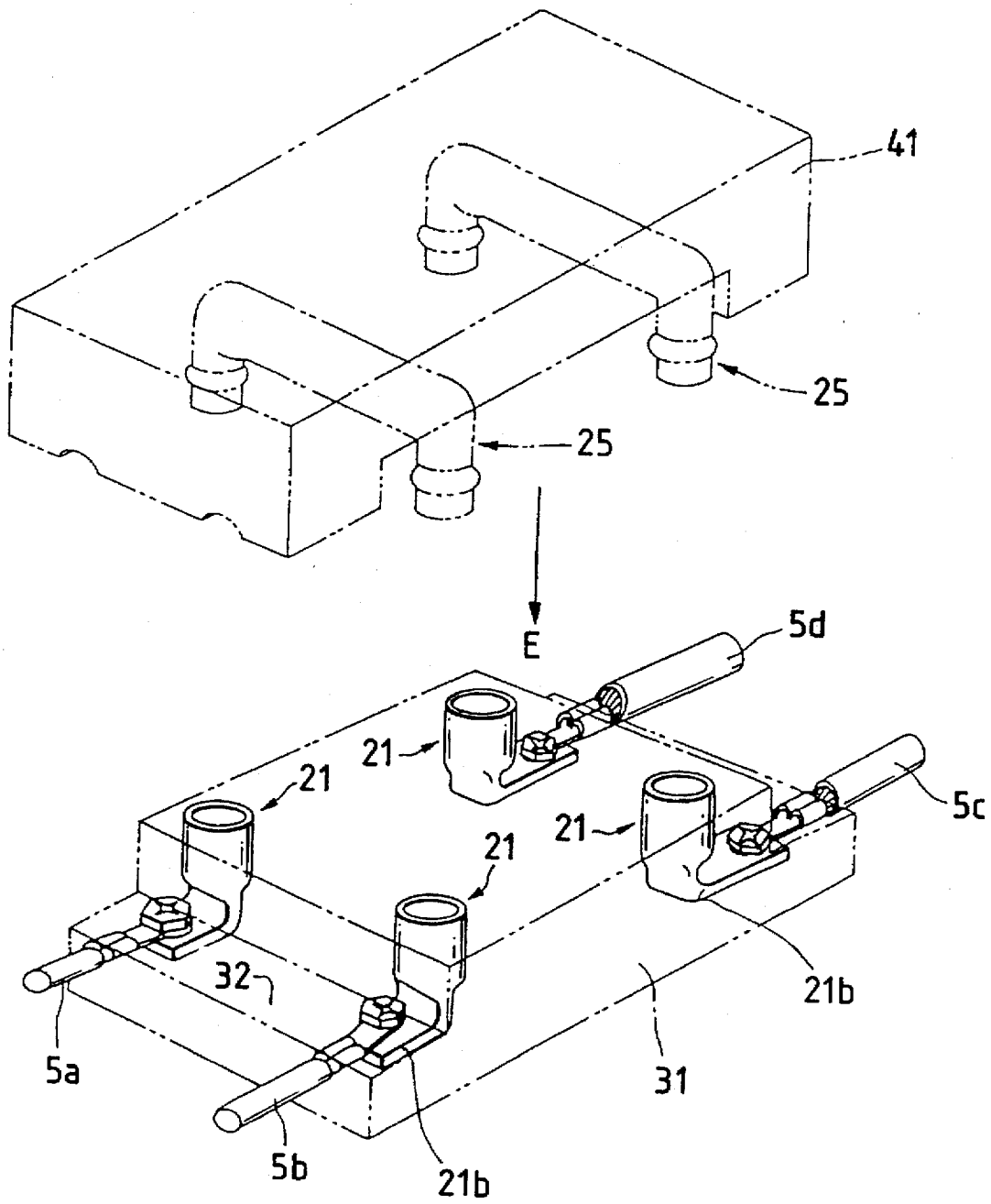
FIG. 9 is a typical perspective view showing the basic structure of the connector apparatus.
Figure 12:
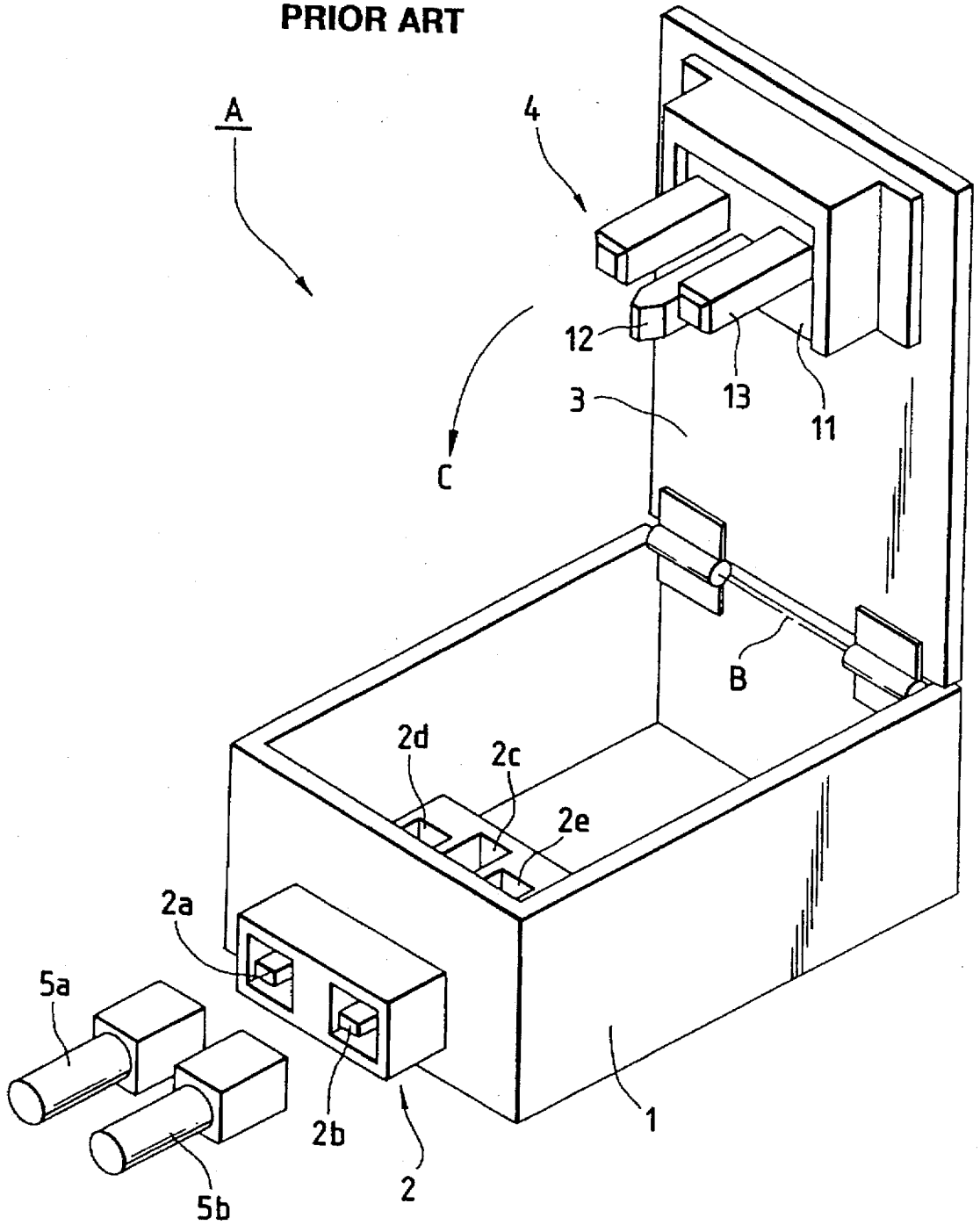
FIG. 12 PRIOR ART
FIG. 12 is a perspective view showing an example of a conventional connector apparatus.
Figure 13:
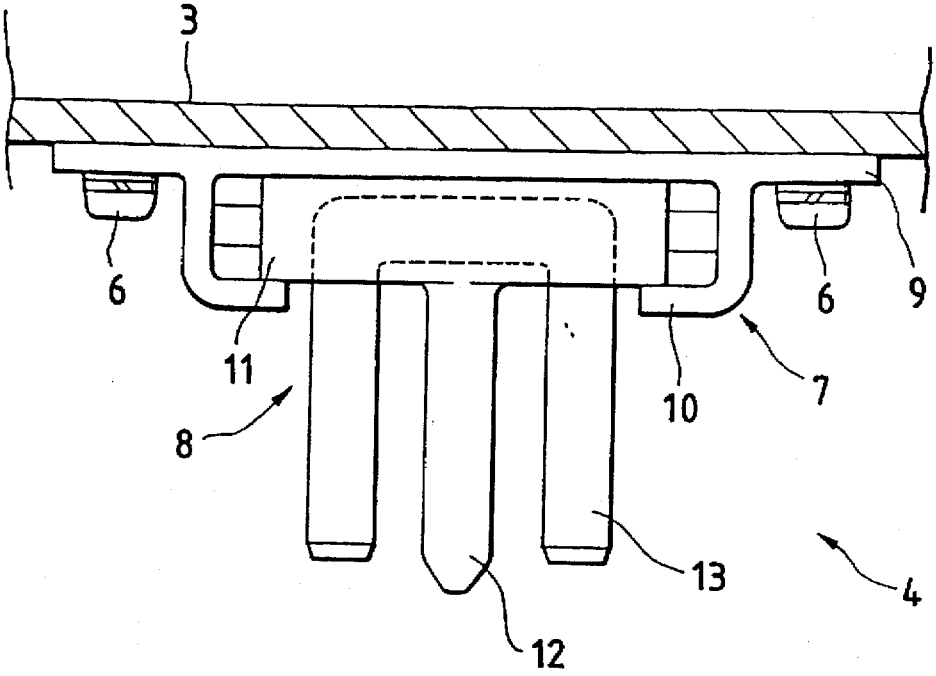
FIG. 13 PRIOR ART
FIG. 13 is a sectional side view of the connector apparatus depicted in FIG. 12.
Figure 14:
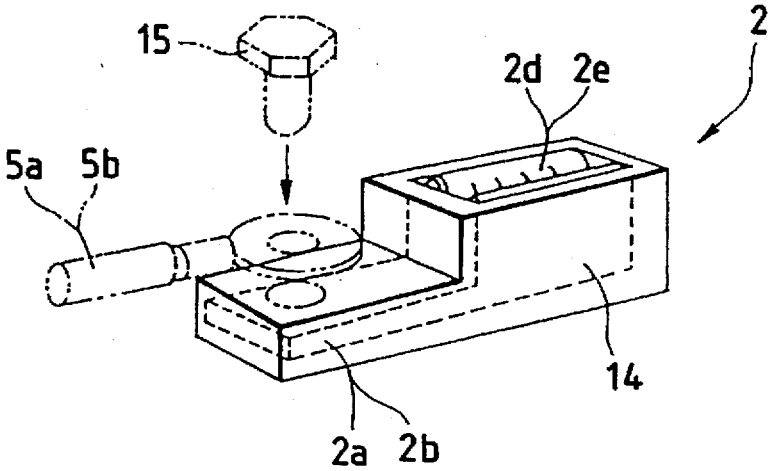
FIG. 14 PRIOR ART
FIG. 14 is a perspective view of an example of a conventional female terminal.

FIG. 9 shows the structure of the connector apparatus. In FIG. 9, the first base member 31 is formed like a box as shown in the conventional structure of FIG. 12. Further, the male terminals 25 corresponding to the female terminals 21 are provided with displacement mechanisms for absorbing slight positional displacement between the male terminals 25 and the corresponding female terminals 21.

In the connector apparatus A having the aforementioned structure, when the second base member 41 is moved down, in the direction of the arrow E, so as to be put over the first base member 31, the bent portions 25*a* of the male terminals 25 are inserted into the corresponding fit-engagement portions or holes 21*a* of the female terminals 21 so that current conduction is performed between the pairs of female terminals 21. When the second base member 41 is moved up, in the direction opposite arrow E, so as to be disconnected from the first base member 31, the male terminals 25 are detached from the female terminals 21 so that the circuits are cut off.

Figure 1:
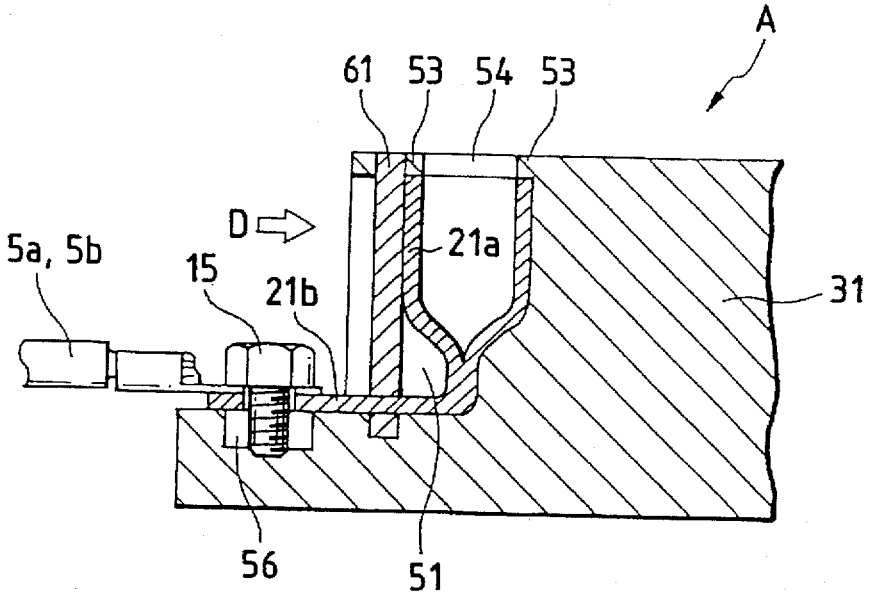
FIG. 1 is a sectional view of the structure of a connector apparatus according to an embodiment of the present invention.

A specific example of how the female terminals 21 are insertable into the base member 31 will be described with reference to FIGS. 1 and 10. Incidentally, because the four female terminals 21 are attached in the same manner, the following description will be made only for one of the female terminals, for example, connected to a high-voltage wire 5*a* or 5*b*.

The female terminal 21 is buried and fixed into a burial hole 51 formed in a predetermined position of the first base member 31. The burial hole 51 is formed when the first base member 31 is molded of a synthetic resin. Further, because the female terminal 21 is formed by pressing one end of a pipe material 22, projections 21*e* as shown in FIG. 4 are formed by the pressing. Accordingly, the burial hole 51 is formed such that the projections 21*e* can be put therein.

An opening portion 52 which communicates the burial hole 51 is formed in the first base member 31 in the front side of the burial hole 51. An annular flange 53 for stopping the fit-engagement portion 21*a* is formed at an upper end of the burial hole 51. An insertion hole 54 for inserting the bent portion 25*a* of the male terminal 25 is formed in the inside of the flange 53. A slit 55 is formed between the insertion hole 54 and the opening portion 52 so that a stopper 61 which will be described later can be inserted into the slit 55.

Figure 10:
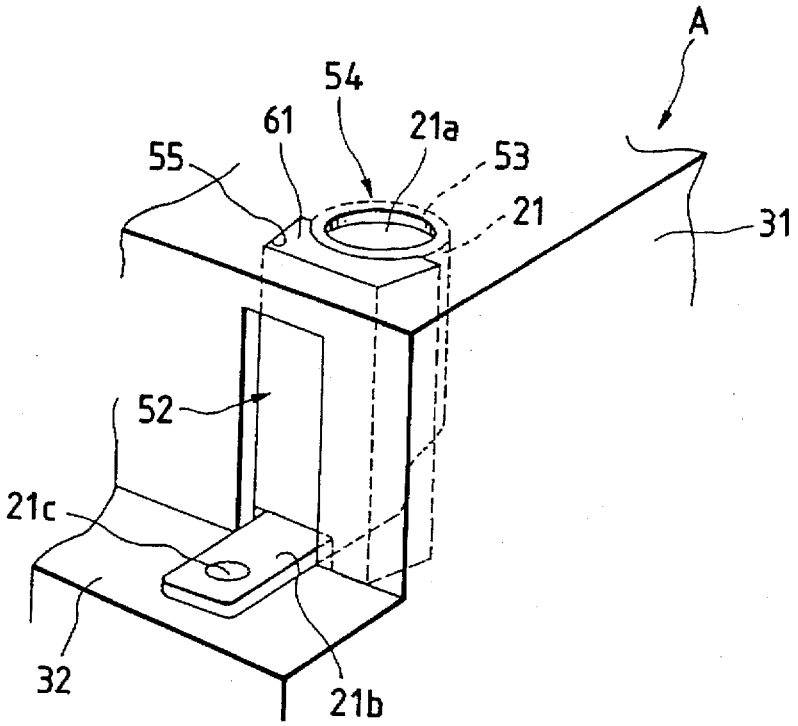
FIG. 10 is a perspective view of the connector apparatus.

The stopper 61 is trapezoidal, as shown in FIG. 10, when viewed in a state in which it has been already inserted. However, the stopper 61 is formed so that the inner wall surface of the stopper 61 is arc-shaped to fit along the outer surface of the fit-engagement portion 21*a*. The outer wall surface of the stopper 61 is shaped like a flat plate to block the opening portion 52 from the inside. Further, the lower end of the stopper 61 is U-shaped so that the connection portion 21*b* is sandwiched between the upper and opposite side surfaces of the stopper 61. The slit 55 is provided to insert the stopper 61 therethrough and the burial hole 51 is formed into a space capable of accommodating the stopper 61 shaped as described above.

Insertion of the female terminal will be now described. As indicated by the arrow D in FIG. 1, the fit-engagement portion 21*a* of the female terminal 21 is inserted into the burial hole 51 through the opening portion 52. Then, the fit-engagement portion 21*a* is pushed up so that the end portion of the fit-engagement portion 21*a* is brought into contact with the flange 53 to thereby perform positioning of the fit-engagement portion 21*a* in the burial hole 51. Because the burial hole 51 is not shaped like a cylinder but shaped to accomodate the projections 21*e*, the female terminal 21 is at this point very loose. Furthermore, the connection portion 21*b* is exposed on the step portion 32 and the screwhole 21*c* is formed in a position corresponding to a nut buried in the step portion 32.

Then, the stopper 61 is inserted into the slit 55. Specifically, the stopper 61 is inserted into the slit 55 after an adhesive agent is applied onto the stopper 61 or after an adhesive agent is injected into the burial hole 51. As a result, not only is the opening portion 52 blocked by the stopper 61 but also female terminal 21 is fixed in the burial hole 51 while being fixed by the stopper 61 from the side.

After all female terminals 21 are fixed into respective burial holes 51 in the manner as described above, high-voltage wires 5*a*, 5*b*, 5*c*, and 5*d* are connected to respective connection portions 21*b* by driving screws 15. Thus, the assembling of the first base member 31 is completed.

In the connector apparatus A of this embodiment, not only can the production of female terminals 21 can be performed easily but also the insertion of the female terminals 21 can be performed easily. Accordingly, the labor required for assembling the connector apparatus A can be greatly reduced, so that reduction in cost can be attained.

Although the aforementioned embodiment has shown a structure in which high-voltage wires 5*c* and 5*d* are connected to female terminals 21, the present invention can be also applied to a dummy structure in which there is no high-voltage wiring connected to the female terminals 21 so that the female terminals 21 are provided as means merely for preventing the second base member 41 from being inclined to one side and being put obliquely over the first base member 31.

Figure 11:
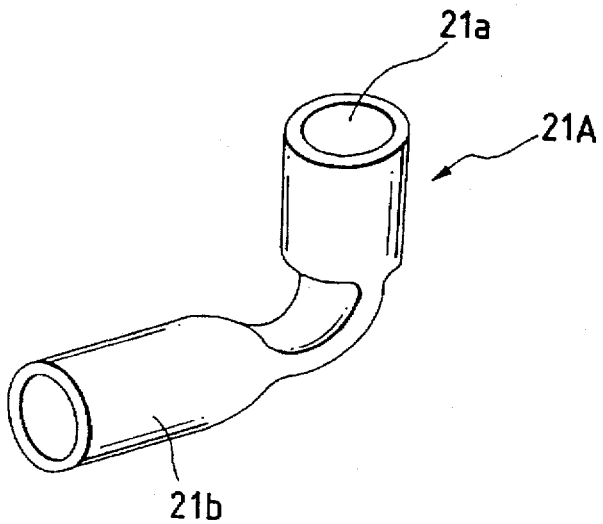
FIG. 11 is a plan view showing the external appearance of another female terminal.

Although an embodiment of the present invention has been described, it is to be understood that the present invention is not limited to the aforementioned structure and that various changes may be made. For example, a terminal structure machined as shown in FIG. 11 may be used as the structure of the female terminal. That is, the female terminal 21A is designed so that the substantially center portion of an electrically conductive pipe material 22 cut into a specific length is crimped and bent into an L shape. A first end of the female terminal 21A remains as a pipe-like shape in the same manner as in the previous embodiment, that is, an end of the female terminal 21A forms a fit-engagement portion 21*a* into which a pin-type terminal can be inserted. Further, the other end of the female terminal 21A forms a connection portion 21*b* in which an electrically conductive material exposed at an end portion of an electric wire is inserted and then caulked from the outside so that the electric wire can be connected in a solderless manner.

Using female terminals 21A, a connector apparatus (not shown) is formed wherein the connection portions 21*b* of the female terminals 21A are exposed to the outer surface of the first base member. Accordingly, high-voltage wires 5*a* and 5*b* can be connected to the female terminals 21A through the connection portions 21*b* easily.

The aforementioned embodiments have shown a connector apparatus A formed so that the second base member is provided like a cover for the first base member and is placed over the first base member. However, the present invention can be also applied to the case where the second base member is rotatably pivoted on the first base member and the angle of bending of the female terminal 21 or 21A is set to be larger than 90° along the locus of the rotation of the male terminal 25, so that the male terminal 24 of the second base member can be inserted into the fit-engagement portion 21*a*, in the same manner as in the conventional case shown in FIG. 12. However, in the latter structure, it is impossible to arrange terminals near the rotation shaft. Further, the connection portion 21*b* may be formed without bending. In this, the connection portion 21*b* need not be placed on the step portion 32 but may be formed to pierce through the base member 31 to the back of the base member 31. In short, the present invention is not limited to the aforementioned embodiments but the present invention may be configured in accordance with the shape and purpose of the connector apparatus A.

As described above, the terminal structure for the connector apparatus according to the present invention is such that an electrically conductive pipe material, which is a standard article, is cut into a specific length. One end of the pipe material is shaped by pressing or the like so as to be a connection portion to which a wiring material is to be connected, and the other end of the pipe material is formed into a fit-engagement portion into which a counter terminal is inserted for connecting to another terminal to thereby make current conduction to the other terminal possible. Further, the counter terminal is formed from an electrically conductive round rod. Accordingly, the production of terminals can be performed very easily, so that the labor required for the production of terminals can be saved to attain reduction in cost. Further, by using pipe materials different in diameter as occasion demands, various types of terminals can be obtained easily, so that the degree of freedom in planning is improved. Further, because a plate spring is wound on the counter terminal, the efficiency of mounting the counter terminal is improved greatly.

Further, according to the connector apparatus using the aforementioned terminals, terminals are inserted into burial holes formed in a base member and then stoppers are inserted into opening portions for inserting terminals so that blocking the opening portions and fixing the terminals are performed. Accordingly, the insertion of the terminals to the connector apparatus is performed easily. The labor required for the production of the connector apparatus can thus be reduced to attain further reduction in the cost of products.

What is claimed is:

1. An electrically conductive terminal of a connector apparatus, comprising:

a crimped center portion;

a first end, cylindrically shaped, formed into a fit-engagement portion into which a pin-type terminal can be fitted, and having an air hole bored in said fit-engagement portion; and a second end, opposite said first end, formed into a connection portion into which an electric wire is to be connected.

2. An electrically conductive terminal of a connector apparatus, comprising:

a first end, cylindrically shaped, formed into a fit-engagement portion into which a pin-type terminal can be fitted, and having an air hole bored in said fit-engagement portion; and a second end, opposite said first end, crimped flat to form a connection portion into which an electric wire is to be connected.

3. A terminal according to claim 2, further comprising a hole bored through said flat second end perpendicular to a plane of said flat end.

4. A terminal according to claim 1, wherein said terminal is substantially L-shaped.

5. A terminal according to claim 2, wherein said terminal is substantially L-shaped.

6. A terminal according to claim 3, wherein said terminal is substantially L-shaped.

7. A connector apparatus, comprising:

a first base member, having a main portion and a stepped portion, a side wall of said main portion being substantially perpendicular to a top surface of said stepped portion;

a second base member, matable with said first base member;

burial holes, provided in said first base member near said stepped portion;

electrically conductive terminals, respectively disposed in said burial holes, each of said electrically conductive terminals having a cylindrically shaped first end formed into a fit-engagement portion into which a pin-type terminal can be fitted, an air hole bored in said fit-engagement portion, and a second end opposite said first end crimped flat to form a connection portion into which an electric wire is to be connected; and pin-type terminals provided in said second base member in positions corresponding to said electrically conductive terminals so as to be mated with said electrically conductive terminals when said second base member is mated with said first base member.

8. A connector apparatus according to claim 7, wherein each of said electrically conductive terminals further comprises a hole bored through said flat second end perpendicular to a plane of said flat end.

9. A connector apparatus according to claim 7, wherein said flat second end of each said electrically conductive terminals is disposed over said top surface of said stepped portion.

10. A connector apparatus according to claim 8, wherein said flat second end of each said electrically conductive terminals is disposed over said top surface of said stepped portion.

11. A connector apparatus according to claim 10, wherein said flat second end of each said electrically conductive terminals is fastened to said top surface via a fastener disposed through said hole in said flat second end.

12. A connector apparatus, comprising:

a first base member, having a main portion and a stepped portion, a side wall of said main portion being substantially perpendicular to a top surface of said stepped portion;

a second base member, matable with said first base member;

burial holes, provided in said first base member near said stepped portion;

electrically conductive terminals, respectively disposed in said burial holes, each of said electrically conductive terminals having a cylindrically shaped first end formed into a fit-engagement portion into which a pin-type terminal can be fitted, and a second end opposite said first end crimped flat to form a connection portion into which an electric wire is to be connected;

pin-type terminals provided in said second base member in positions corresponding to said electrically conductive terminals so as to be mated with said electrically conductive terminals when said second base member is mated with said first base member;

opening portions respectively disposed in said side wall of said main portion near said burial holes;

slits, respectively disposed adjacent said burial holes between said burial holes and said opening portions; and stoppers, respectively insertable into said slits, which, when inserted, fix said electrically conductive terminals in said burial holes and close said opening portions.

13. A connector apparatus according to claim 12, wherein each of said pin-type terminals comprises:

a rod-shaped main body having a diameter smaller than an inner diameter of said first end of said electrically conductive terminals;

a concave lock portion hollowed out of said main body; and convex plate spring pieces disposed in said concave lock portion bowing away from said concave lock portion, said plate spring pieces engaging said electrically conductive terminals when said pin-type terminals and said electrically conductive terminals are mated.

* * * * *